US012044021B2

(12) United States Patent
Schwartz

(10) Patent No.: US 12,044,021 B2
(45) Date of Patent: Jul. 23, 2024

(54) ROOFER SUPPORT APPARATUS

(71) Applicant: Russell Schwartz, Estelline, SD (US)

(72) Inventor: Russell Schwartz, Estelline, SD (US)

( * ) Notice: Subject to any disclaimer, the term of this patent is extended or adjusted under 35 U.S.C. 154(b) by 452 days.

(21) Appl. No.: 17/235,430

(22) Filed: Apr. 20, 2021

(65) Prior Publication Data

US 2022/0333389 A1 Oct. 20, 2022

(51) Int. Cl.
*E04G 3/26* (2006.01)
*E04G 3/32* (2006.01)
*E04G 3/34* (2006.01)

(52) U.S. Cl.
CPC ..... *E04G 3/26* (2013.01); *E04G 3/265* (2013.01); *E04G 3/32* (2013.01); *E04G 3/34* (2013.01)

(58) Field of Classification Search
CPC .. E04G 3/26; E04G 3/265; E04G 3/32; E04G 3/34; E04G 5/06; E04B 7/20; E04B 7/205; E04B 7/24
See application file for complete search history.

(56) References Cited

U.S. PATENT DOCUMENTS 232,324 A * 9/1880 Ashlock ..... E04G 3/26 182/147
815,254 A * 3/1906 Barnes ..... E04G 3/26 248/237
1,133,878 A * 3/1915 Nagel ..... E04G 3/26 248/237
1,152,685 A * 9/1915 Winn ..... E04G 3/26 248/237
1,363,864 A * 12/1920 Grush ..... E04G 5/041 248/237
3,842,934 A * 10/1974 Bartlett ..... E04G 3/26 182/45
3,866,715 A * 2/1975 Foulk ..... E04G 3/26 248/237
4,078,633 A * 3/1978 Fahy ..... E04G 3/265 182/229
4,121,690 A * 10/1978 Rawlings ..... E04G 3/26 182/45
4,132,287 A * 1/1979 Parolini ..... E04G 3/265 182/45
4,398,620 A * 8/1983 Townsend ..... E04G 3/265 182/17

(Continued)

FOREIGN PATENT DOCUMENTS

EP 1482104 A1 * 12/2004 ..... E04G 3/22

OTHER PUBLICATIONS

EP-1482104-A1 Translation (Year: 2004).*

*Primary Examiner* — Jessica L Laux
*Assistant Examiner* — Kathleen M. McFarland

(57) ABSTRACT

A roofer support apparatus for providing a level support on a pitched roof includes a base mount with a plurality of adjustment apertures and a chain slot. A mount bottom side is positioned on a pitched roof. A support is pivotably coupled to the base mount and receives a board. A pivot bracket is coupled to the support and is selectively engageable with two of the plurality of adjustment apertures to fix the pivot bracket to the base mount with the support horizontal. A chain is coupled to the base mount and is selectively engageable with the chain slot of the mount front side. A chain anchor is coupled to the chain. The chain anchor is secured to an opposite roof side of the pitched roof.

8 Claims, 6 Drawing Sheets

(56) References Cited

U.S. PATENT DOCUMENTS 4,450,935 A * 5/1984 Gustavus ..... E06C 7/16 248/237
4,453,619 A * 6/1984 Bierman ..... E04G 3/34 182/150
4,676,341 A * 6/1987 Shaffstall ..... E04G 5/041 182/178.1
4,785,606 A * 11/1988 Burton ..... E04G 3/265 52/749.12
4,884,775 A * 12/1989 Fischer, Jr. ..... E04G 5/041 248/242
5,050,705 A * 9/1991 Natwick ..... E04G 3/265 248/237
5,113,971 A * 5/1992 Violet ..... E04G 3/26 248/237
5,143,170 A * 9/1992 Hunt ..... E04G 21/3295 248/237
5,249,397 A * 10/1993 Monaco ..... E04G 3/265 52/126.1
5,318,148 A * 6/1994 Franco ..... E04G 3/26 248/237
5,320,194 A * 6/1994 Bredijk ..... E04G 3/26 248/237
5,515,941 A * 5/1996 Palmer ..... E04G 5/041 52/27
5,624,006 A * 4/1997 Richardson, Jr. ..... E06C 7/16 248/237
5,845,740 A * 12/1998 Bouwkamp ..... A62B 1/04 248/237
5,862,880 A * 1/1999 Nelson ..... E04G 5/041 248/237
5,908,083 A * 6/1999 Hamilton ..... E04D 15/02 182/206
5,913,782 A * 6/1999 Monaco ..... E04G 3/26 52/126.1
5,979,600 A * 11/1999 Bitner ..... E04G 3/26 52/27
6,082,689 A * 7/2000 Bushway ..... E04G 5/04 248/237
6,167,987 B1 * 1/2001 Jensen ..... E04G 5/041 248/237
6,220,390 B1 * 4/2001 Pike ..... E04G 3/26 248/237
6,470,646 B1 * 10/2002 Bryant ..... E04G 3/28 52/749.12
6,484,986 B1 * 11/2002 Kolodzieski ..... E04G 5/041 248/237
6,732,480 B1 * 5/2004 Smith ..... E04D 15/00 52/749.12
6,745,869 B2 * 6/2004 Garrett ..... E04D 15/00 182/45
6,857,504 B1 * 2/2005 Branter ..... E04G 21/3266 248/237
7,195,099 B2 * 3/2007 Harney ..... E04G 5/02 248/237
7,424,932 B1 * 9/2008 Murphy ..... E06C 1/345 182/103
7,493,737 B2 * 2/2009 Smith ..... E04G 3/26 52/749.12
8,025,126 B1 * 9/2011 Lefavor ..... E04G 21/3261 248/237
8,186,479 B2 * 5/2012 Vieira ..... E04G 3/265 182/129
8,596,414 B1 * 12/2013 Lown ..... E04G 3/28 182/45
8,714,305 B2 * 5/2014 Fontaine ..... E04G 3/265 182/45
9,109,371 B2 * 8/2015 Hudson ..... E04D 15/00
2002/0109059 A1 * 8/2002 Macri ..... E04G 3/26 248/237
2002/0153200 A1 * 10/2002 Bryant ..... E04G 3/28 248/237
2003/0042377 A1 * 3/2003 Macri ..... E04G 3/265 248/237
2003/0230451 A1 * 12/2003 Garrett ..... B23D 61/12 182/45
2004/0128945 A1 * 7/2004 Smith ..... E04G 3/26 52/749.12
2005/0072096 A1 * 4/2005 Harney ..... E04G 5/02 52/632
2005/0223660 A1 * 10/2005 Henning, Sr. ..... E04G 3/26 52/203
2006/0289233 A1 * 12/2006 Flaherty ..... E04G 21/3276 182/45
2007/0034449 A1 * 2/2007 Leendertse ..... E04G 3/26 182/45
2007/0062761 A1 * 3/2007 Megna ..... E04G 3/26 182/45
2008/0006481 A1 * 1/2008 Vieira ..... E04G 3/265 182/45
2008/0142302 A1 * 6/2008 Jost ..... E04G 3/265 182/222
2012/0061178 A1 * 3/2012 Mathieson ..... E04G 3/26 182/45
2012/0080264 A1 * 4/2012 Lord ..... E04G 3/26 182/45
2012/0118667 A1 * 5/2012 Fontaine ..... E04G 3/26 248/237
2012/0267193 A1 * 10/2012 Fontaine ..... E04G 5/041 182/230
2013/0087669 A1 * 4/2013 Daddio ..... E04G 21/3276 248/237
2015/0041251 A1 * 2/2015 Hudson ..... E04D 15/00 182/45
2019/0078339 A1 * 3/2019 Robinson ..... E04G 23/0281
2022/0127865 A1 * 4/2022 Taylor ..... E04G 21/3214

* cited by examiner

ROOFER SUPPORT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to roofing devices and more particularly pertains to a new roofing device for providing a level support on a pitched roof. The present device includes a base mount and a pivoting support to receive a board with a second device. The base mount receives a chain which is then anchored to the opposite side of the pitched roof.

(2) Description of Related Art Including Information Disclosed Under 37 CFR 1.97 and 1.98

The prior art relates to roofing devices. Known devices include bases and adjustable supports in order to provide horizontal surfaces. These devices typically create a horizontal platform to receive tools and the like and do not receive a longer board in conjunction with a second device. These devices also lack a chain running across to be secured on the opposite side of the roof.

BRIEF SUMMARY OF THE INVENTION

An embodiment of the disclosure meets the needs presented above by generally comprising a base mount having a mount front side, a mount back side, an open mount top side, a mount bottom side, a mount left side, and a mount right side. The mount left side and the mount right side have a plurality of adjustment apertures. The mount front side has a chain slot. The mount bottom side is configured to be positioned on a pitched roof. A support is coupled to the base mount. The support ha a support proximal end pivotably coupled to the mount left side and the mount right side and a support distal end. The support is configured to receive a board. A pivot bracket is coupled to the support. The pivot bracket is pivotably coupled to the support distal end. An adjustment pin is coupled to the pivot bracket. The adjustment pin is selectively engageable with two of the plurality of adjustment apertures to fix the pivot bracket to the base mount with the support horizontal. A chain is coupled to the base mount. The chain is selectively engageable with the chain slot of the mount front side. A chain anchor is coupled to the chain. The chain anchor is configured to be secured to an opposite roof side of the pitched roof.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
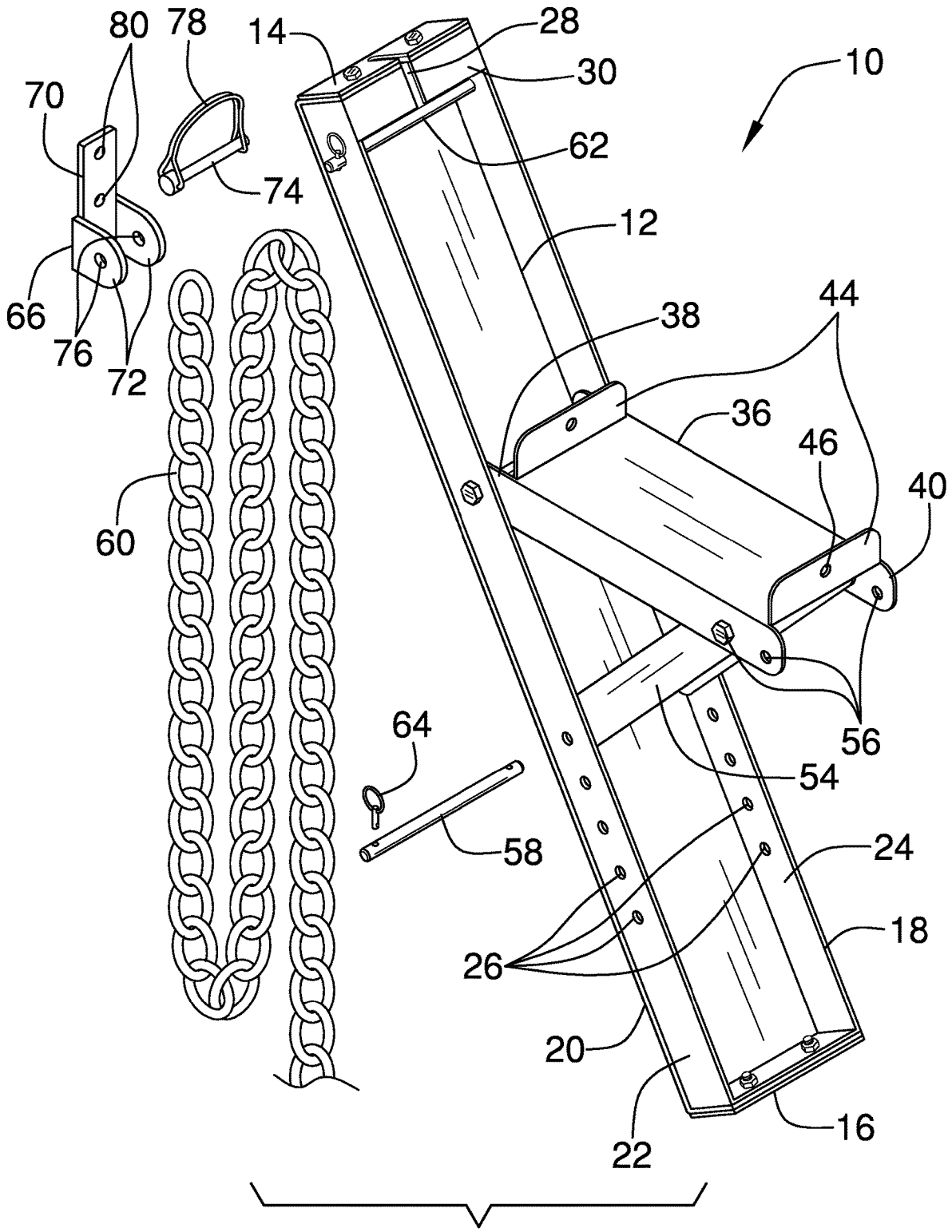
FIG. 1 is an isometric view of a roofer support apparatus according to an embodiment of the disclosure.
Figure 2:
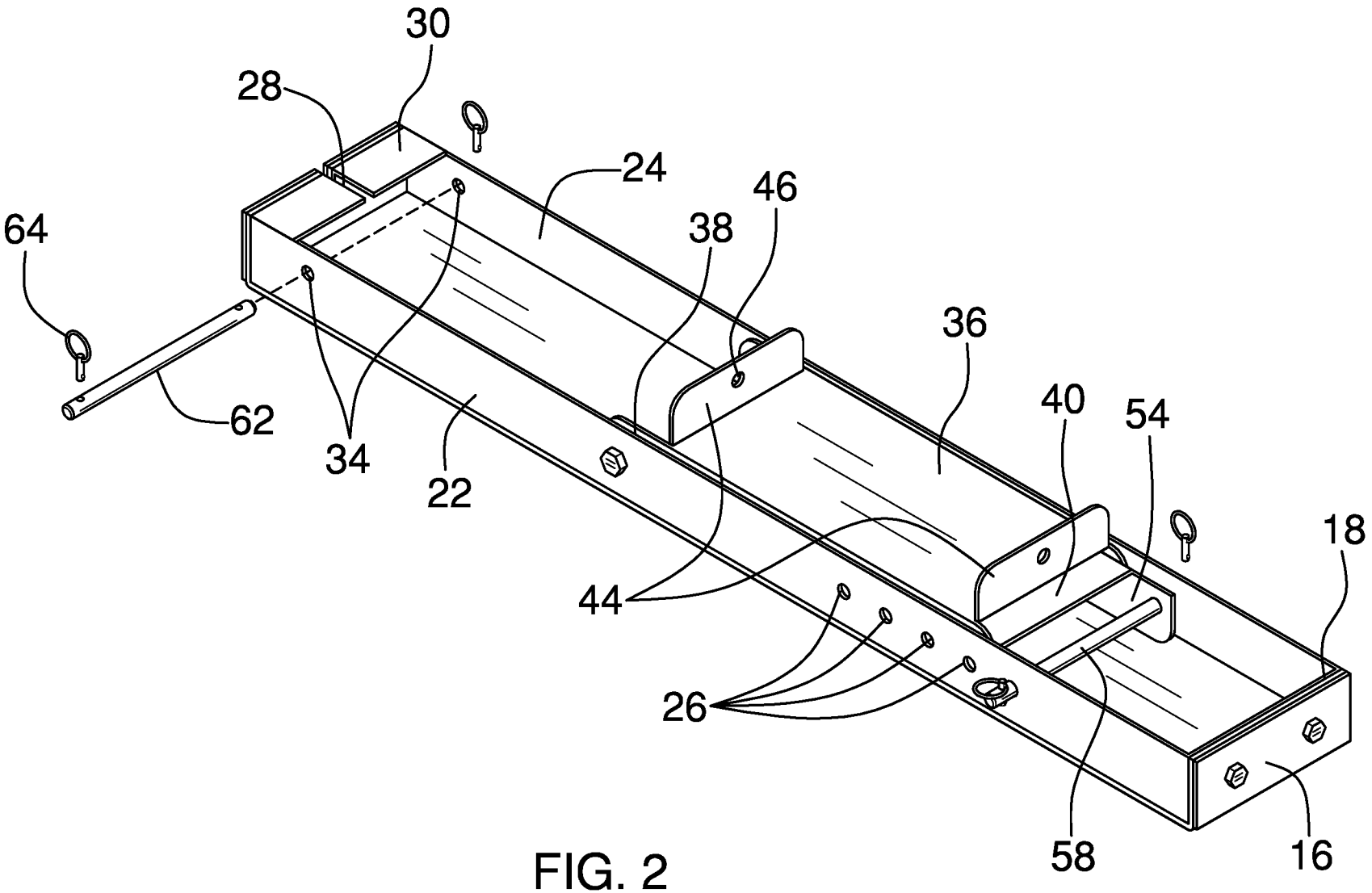
FIG. 2 is an isometric view of an embodiment of the disclosure.
Figure 3:
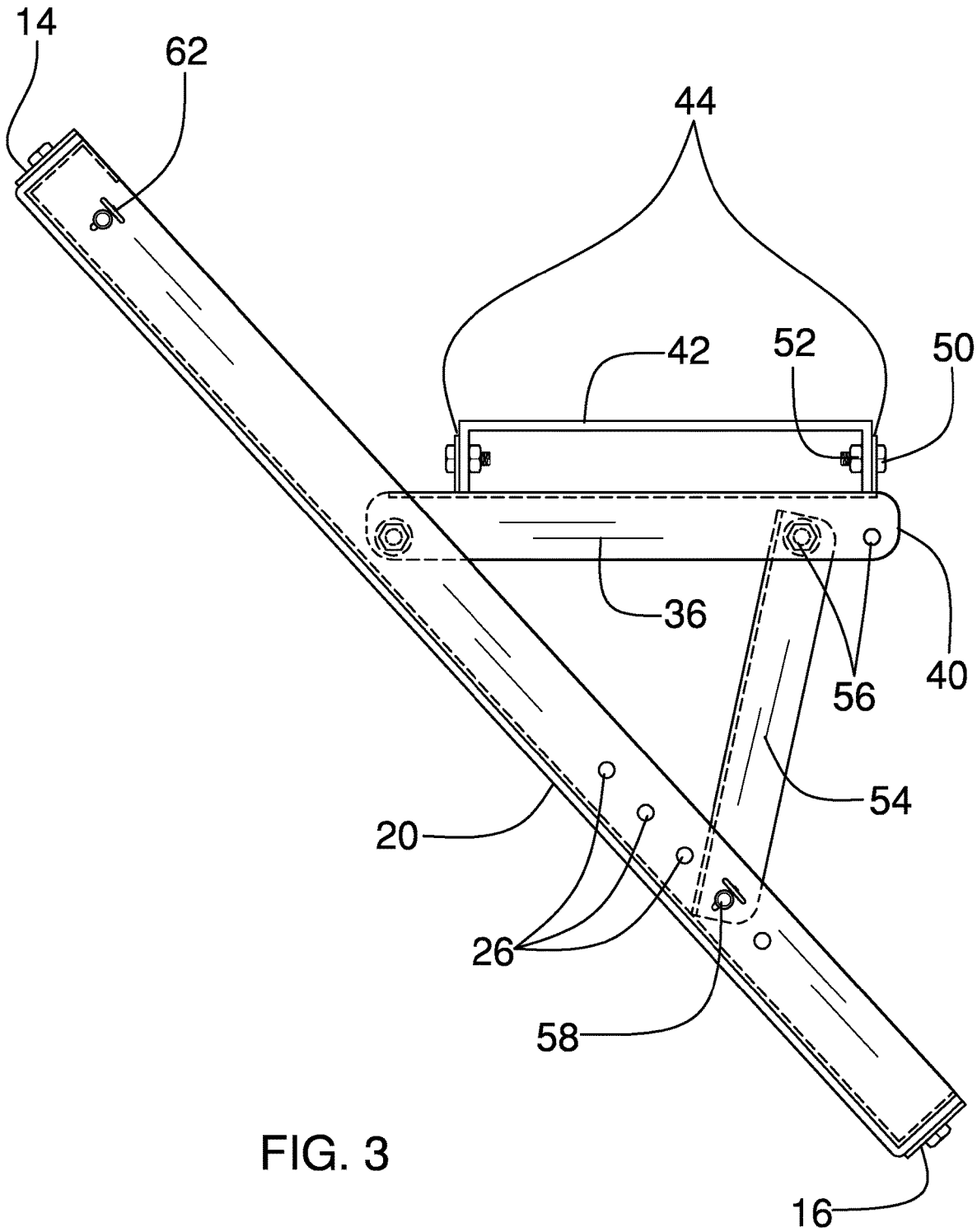
FIG. 3 is a side elevation view of an embodiment of the disclosure.

With reference now to the drawings, and in particular to FIGS. 1 through 6 thereof, a new roofing device embodying the principles and concepts of an embodiment of the disclosure and generally designated by the reference numeral 10 will be described.

As best illustrated in FIGS. 1 through 6, the roofer support apparatus 10 generally comprises a base mount 12 having a mount front side 14, a mount back side 16, an open mount top side 18, a mount bottom side 20, a mount left side 22, and a mount right side 24. The mount left side 22 and the mount right side 24 each have a plurality of adjustment apertures 26. The mount front side 14 has a chain slot 28. The mount front side 14 may have an upper catch portion 30 extending along the mount top side 18 with the chain slot 28 extending through the upper catch portion 30. The mount bottom side 20 is configured to be positioned on a pitched roof 32. The base mount 12 may have a chain pin aperture 34 extending from the mount left side 22 through the mount right side 24.

Figure 4:
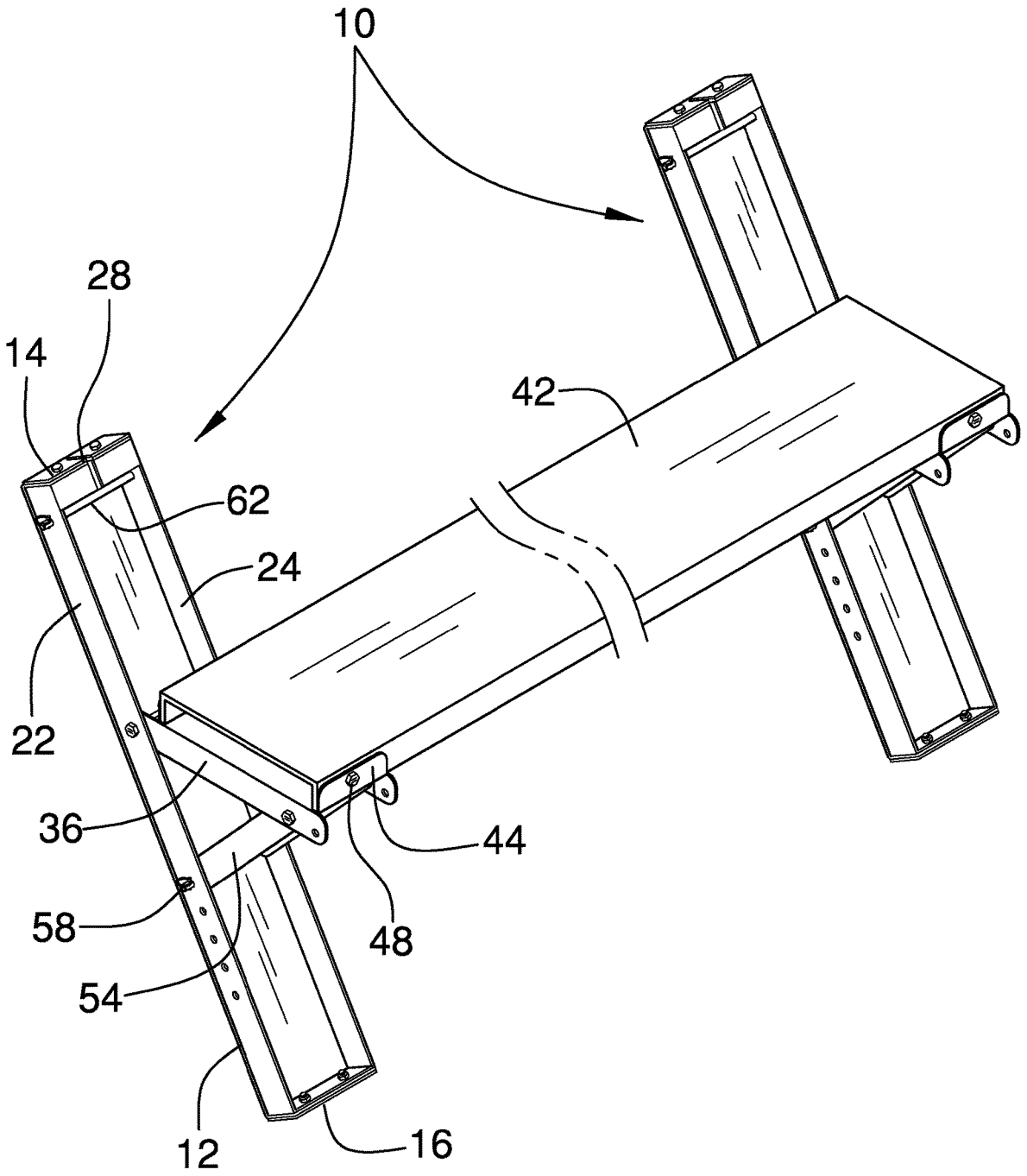
FIG. 4 is an isometric view of an embodiment of the disclosure.
Figure 5:
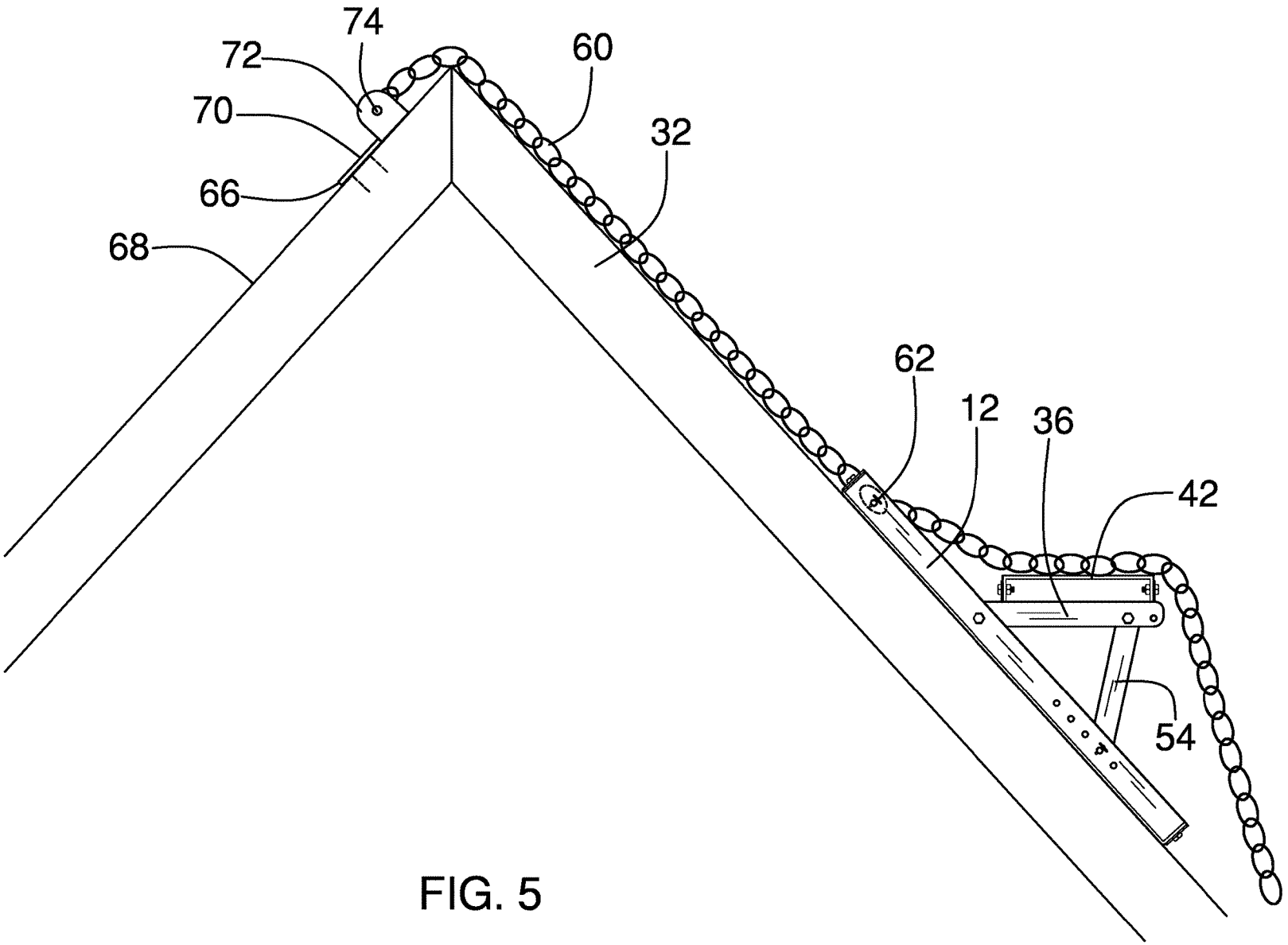
FIG. 5 is an in-use side elevation view of an embodiment of the disclosure.
Figure 6:
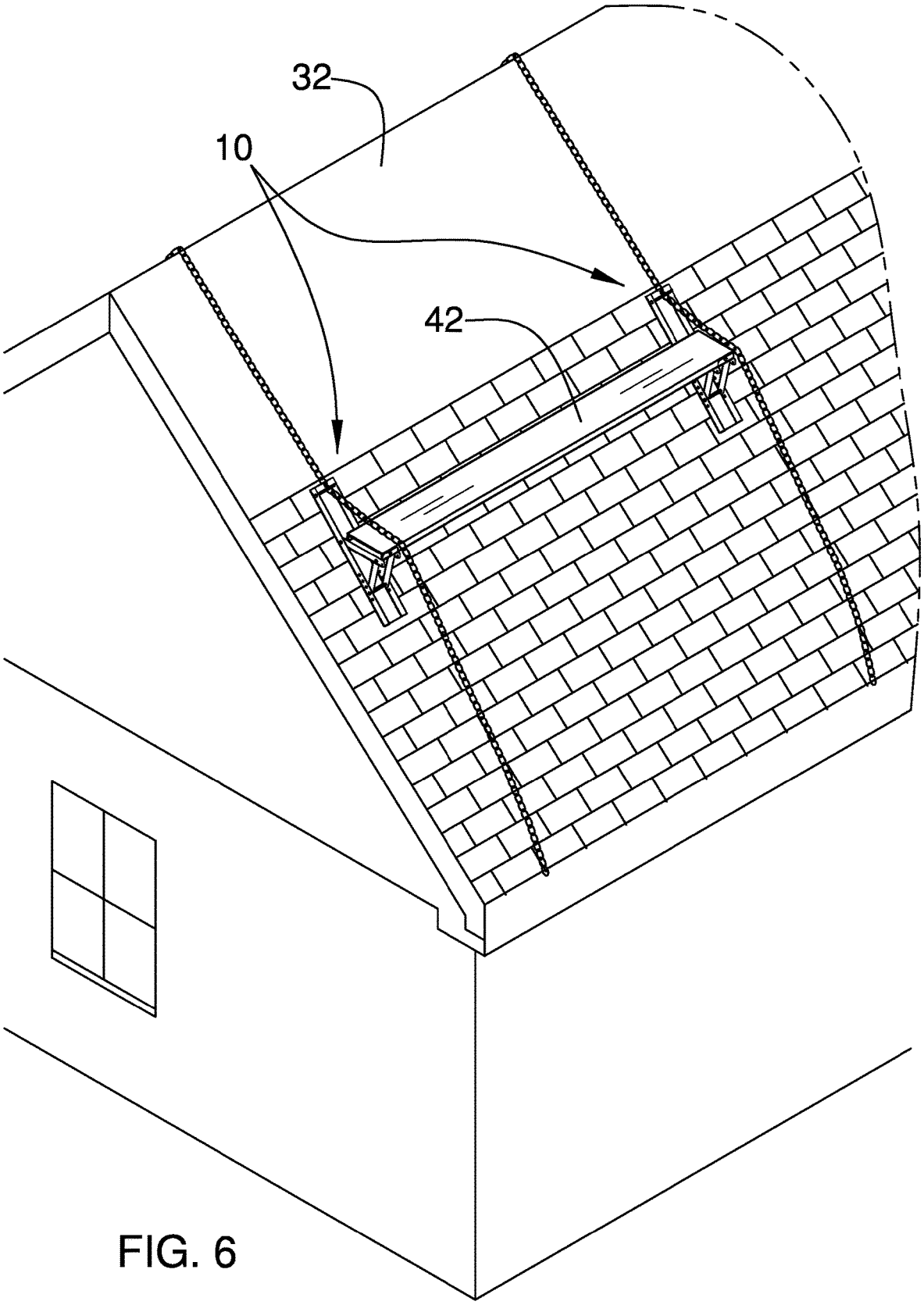
FIG. 6 is an in-use isometric view of an embodiment of the disclosure.

A support 36 coupled to the base mount 12. The support 36 has a support proximal end 38 pivotably coupled to the mount left side 22 and the mount right side 24 and a support distal end 40. The support 36 is configured to receive a board 42. The board 42 extends between the support 36 of two apparatuses 10 as shown in FIGS. 4 and 6. The support 36 may have a pair of perpendicular lips 44 proximal the support proximal end 38 and the support distal end 40. The board 42 fits between the pair of perpendicular lips 44. Each of the pair of perpendicular lips 44 may have a safety aperture 46 extending therethrough. The safety aperture 46 is configured to receive a safety hardware 48 to engage the board 42. The board 42 may be a channel board 42 as shown in FIG. 5, allowing the safety hardware 48 to include a bolt 50 and a nut 52.

A pivot bracket 54 is coupled to the support 36. The pivot bracket 54 is pivotably coupled to the support distal end 40. The pivot bracket 54 may be selectively engageable with a plurality of pivot bracket apertures 56 extending through the support 36. An adjustment pin 58 is coupled to the pivot bracket 54. The adjustment pin 58 is selectively engageable with two of the plurality of adjustment apertures 26 to fix the pivot bracket 54 to the base mount 12 with the support 36 horizontal.

A chain 60 is coupled to the base mount 12. The chain 60 is selectively engageable with the chain slot 28 of the mount front side. A chain securing pin 62 is selectively engageable with the chain pin aperture 34 and the chain 60 for added security. Each of the chain securing pin 62 and the adjustment pin 58 may have a pair of locking clips 64 to prevent accidental removal.

A chain anchor 66 is coupled to the chain 60. The chain anchor 66 is configured to be secured to an opposite roof side 68 of the pitched roof. The chain anchor 66 may include a mounting bracket 70, a pair of ears 72 extending from the mounting bracket 70, and an anchor pin 74 selectively engageable with a pair of ear apertures 76 of the pair of ears. The anchor pin 74 may have a U-shaped pin retaining clip 78 to prevent accidental disengagement. The mounting bracket 70 has a plurality of mounting apertures 80 configured to receive hardware to engage the pitched roof 32.

In use, the base mount 12 is placed on the pitched roof 32 and the pivot bracket 54 is adjusted until the support 36 is horizontal. The adjustment pin 58 is engaged to hold the pivot bracket 54 in place. The chain anchor 66 is then secured to the opposite roof side 68 and the chain 60 is fixed to the chain anchor 66 with the anchor pin 74. The apparatus 10 is then placed at a desired location on the pitched roof 32 and the chain 60 is engaged with the chain slot 28 and the chain securing pin 62. The board 42 may then be supported on the support 36 between two apparatuses 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A roofer support apparatus comprising:

a base mount having a mount front side, a mount back side, an open mount top side, a mount bottom side, a mount left side, and a mount right side, the open mount top side being planar, the mount left side and the mount right side having a plurality of adjustment apertures, the mount front side having a chain slot, the chain slot extending further through an upper catch extending from the mount front side into the open mount top side, the mount bottom side being configured to be positioned on a pitched roof;

a support coupled to the base mount, the support having a support proximal end pivotably coupled to the mount left side and the mount right side and a support distal end, the support being configured to receive a board;

a pivot bracket coupled to the support, the pivot bracket being pivotably coupled to the support distal end;

an adjustment pin coupled to the pivot bracket, the adjustment pin being selectively engageable with two of the plurality of adjustment apertures to fix the pivot bracket to the base mount with the support horizontal;

a chain coupled to the base mount, the chain being selectively engageable with the chain slot of the mount front side by passing a link of the chain laterally into the chain slot such that the chain link is held in the chain slot by the upper catch; and a chain anchor coupled to the chain, the chain anchor being configured to be secured to an opposite roof side of the pitched roof.

2. The roofer support apparatus of claim 1 further comprising the chain anchor including a mounting bracket, a pair of ears extending from the mounting bracket, and an anchor pin selectively engageable with a pair of ear apertures of the pair of ears, the mounting bracket having a plurality of mounting apertures configured to receive hardware to engage the pitched roof.

3. The roofer support apparatus of claim 1 further comprising the base mount having a chain pin aperture extending from the mount left side through the mount right side; a chain securing pin being selectively engageable with the chain pin aperture and the chain.

4. The roofer support apparatus of claim 1 further comprising the support having a pair of perpendicular lips proximal the support proximal end and the support distal end, the board fitting between the pair of perpendicular lips.

5. The roofer support apparatus of claim 4 further comprising each of the pair of perpendicular lips having a safety aperture extending therethrough, the safety aperture being configured to receive a safety hardware to engage the board.

6. The roofer support apparatus of claim 5 further comprising the board being a channel board; the safety hardware including a bolt and a nut.

7. A roofer support apparatus comprising:

a base mount having a mount front side, a mount back side, an open mount top side, a mount bottom side, a mount left side, and a mount right side, the open mount top side being planar, the mount left side and the mount right side having a plurality of adjustment apertures, the mount front side having a chain slot, the chain slot extending further through an upper catch extending from the mount front side into the open mount top side, the mount bottom side being configured to be positioned on a pitched roof, the base mount having a chain pin aperture extending from the mount left side through the mount right side;

a support coupled to the base mount, the support having a support proximal end pivotably coupled to the mount left side and the mount right side and a support distal end, the support being configured to receive a board, the board being a channel board, the support having a pair of perpendicular lips proximal the support proximal end and the support distal end, the board fitting between the pair of perpendicular lips, each of the pair of perpendicular lips having a safety aperture extending therethrough, the safety aperture being configured to receive a safety hardware to engage the board, the safety hardware including a bolt and a nut;

a pivot bracket coupled to the support, the pivot bracket being pivotably coupled the support distal end;

an adjustment pin coupled to the pivot bracket, the adjustment pin being selectively engageable with two of the plurality of adjustment apertures to fix the pivot bracket to the base mount with the support horizontal;

a chain coupled to the base mount, the chain being selectively engageable with the chain slot of the mount front side by passing a link of the chain laterally into the chain slot such that the chain link is held in the chain slot by the upper catch;

a chain securing pin being selectively engageable with the chain pin aperture and the chain; and a chain anchor coupled to the chain, the chain anchor being configured to be secured to an opposite roof side of the pitched roof, the chain anchor including a mounting bracket, a pair of ears extending from the mounting bracket, and an anchor pin selectively engageable with a pair of ear apertures of the pair of ears, the mounting bracket having a plurality of mounting apertures configured to receive hardware to engage the pitched roof.

8. A roofer support system comprising:

a board, the board having a board left end and a board right end, the board being a channel board; and a pair of roofer support apparatuses, each roofer support apparatus comprising:

a base mount having a mount front side, a mount back side, an open mount top side, a mount bottom side, a mount left side, and a mount right side, the open mount top side being planar, the mount left side and the mount right side having a plurality of adjustment apertures, the mount front side having a chain slot, the chain slot extending further through an upper catch extending from the mount front side into the open mount top side, the mount bottom side being configured to be positioned on a pitched roof, the base mount having a chain pin aperture extending from the mount left side through the mount right side;

a support coupled to the base mount, the support having a support proximal end pivotably coupled to the mount left side and the mount right side and a support distal end, the support receiving the board, the support having a pair of perpendicular lips proximal the support proximal end and the support distal end, the board fitting between the pair of perpendicular lips, each of the pair of perpendicular lips having a safety aperture extending therethrough, the safety aperture being configured to receive a safety hardware to engage the board, the safety hardware including a bolt and a nut;

a pivot bracket coupled to the support, the pivot bracket being pivotably coupled to the support distal end;

an adjustment pin coupled to the pivot bracket, the adjustment pin being selectively engageable with two of the plurality of adjustment apertures to fix the pivot bracket to the base mount with the support horizontal;

a chain coupled to the base mount, the chain being selectively engageable with the chain slot of the mount front side by passing a link of the chain laterally into the chain slot such that the chain link is held in the chain slot by the upper catch;

a chain securing pin being selectively engageable with the chain pin aperture and the chain; and a chain anchor coupled to the chain, the chain anchor being configured to be secured to an opposite roof side of the pitched roof, the chain anchor including a mounting bracket, a pair of ears extending from the mounting bracket, and an anchor pin selectively engageable with a pair of ear apertures of the pair of ears, the mounting bracket having a plurality of mounting apertures configured to receive hardware to engage the pitched roof.

* * * * *